US006554959B2

(12) United States Patent
Von Paleske et al.

(10) Patent No.: US 6,554,959 B2
(45) Date of Patent: Apr. 29, 2003

(54) TISSUE PAPER MAKING MACHINE

(75) Inventors: Peter Von Paleske, Seeheim-Jugenheim (DE); Walter F. Hill, Hofheim (DE)

(73) Assignee: SCA Hygiene Products GmbH, Mannheim (DE)

( * ) Notice: Subject to any disclaimer, the term of this patent is extended or adjusted under 35 U.S.C. 154(b) by 0 days.

(21) Appl. No.: 09/993,705

(22) Filed: Nov. 27, 2001

(65) Prior Publication Data

US 2002/0112829 A1 Aug. 22, 2002

Related U.S. Application Data

(63) Continuation of application No. PCT/EP00/04557, filed on May 19, 2000.

(30) Foreign Application Priority Data

May 27, 1999 (DE) ..... 199 24 293

(51) Int. Cl.[7] ..... D21F 1/10

(52) U.S. Cl. ..... 162/109; 162/116; 162/203; 162/211; 162/296; 162/300; 162/301

(58) Field of Search ..... 162/116, 109, 162/296, 300, 301, 348, 202, 289, 351, 203, 211

(56) References Cited

U.S. PATENT DOCUMENTS 3,322,617 A * 5/1967 Osborne ..... 162/116

FOREIGN PATENT DOCUMENTS

DE 1 461 082 11/1968
JP 47-7725 * 4/1972 ..... 162/116

* cited by examiner

*Primary Examiner*—Peter Chin
(74) *Attorney, Agent, or Firm*—Young & Thompson

(57) ABSTRACT

A tissue paper making machine, a tissue paper product, and a method for producing such a tissue paper product. According to the invention, a dewatering and sheet-forming wire (13;14) is deposited in the pulp flow area by a texturing wire (16;17) that is provided with a texture comprised of closed wire zones. This results in the production of a tissue paper product having improved optical and haptic properties.

14 Claims, 3 Drawing Sheets

TISSUE PAPER MAKING MACHINE

This application is a continuation of international application PCT/EP00/04557 filed May 19, 2000, which designated the United States.

FIELD OF THE INVENTION

The invention relates to the production of tissue paper, finding application, for example, as kitchen towels, paper handkerchiefs, facials, toilet tissue, napkins and the like.

PRIOR ART

A wide variety of methods and machines is known with which such tissue papers can be produced in the sense of a more textile-like character, good absorptivity, especially good wet and dry tear strength, softness and the like, all of which require no detailing. Reference is made, however, to the German laid-open patent DE-OS 1 461 082 describing a method of making tissue paper having zones differing in basis weight. To block dewatering a modeling wire is placed on the dewatering wire. Both wires have the same extensibility and same roller guidance. The product produced therewith contains, in addition to the sheeting, a structure embossed by the modeling wire, resulting in comparatively sharply defined areas differing in basis weight. The fibers are oriented in the tissue paper with no preferential direction. When crumpled in use, tissue paper having conventionally a homogenous basis weight over its full surface area forms comparatively long creases which present added resistance to the deforming force.

SUMMARY OF THE INVENTION

The invention is based on the technical problem (objective) of providing a machine and a method permitting the achievement of tissue paper having enhanced visual and haptic properties.

With the achievement in accordance with the invention a tissue paper can now be produced which by creating structures of a textile nature conveys an improved visual appearance and "haptic impression", meaning the impression imparted subjectively as sensed by the fingers, i.e. the "feel". What is appreciated particularly is a good combination of surface softness and crumple softness. This is achieved by forming a tissue paper textured in small areas of elevated and diminished basis weight in the macro range. The areas of diminished basis weight offer less resistance to a deforming force than the areas of elevated basis weight in thus shortening the length of the creases resulting from crumpling. The meaning of this is enhanced crumple softness both physically and sensorically.

It is via the closed wire zones or wire mesh of the backing texturing wire that dewatering by the sheet-forming wire in the Z direction is inhibited or strongly restricted, resulting in an added fiber concentration in the zones of unrestricted dewatering.

In the tissue paper product a comparatively vapid transition materializes between areas of high basis weight and areas of lower basis weight which is to be evaluated positive as regards the visual appearance of the product without having any negative effect on the enhanced crumple softness intended. The zones differing in basis weight that form substantially the sole structuring feature. The fibers in the tissue paper permit identifying an orientation in the machining direction. All conventional materials can come into consideration for the wires, e.g. metal-wire or plastics wires.

One objective of the invention is to produce sheet paper not taking on the structure of the wire contacting the paper.

Further advantageous aspects read from the sub-claims. If the backing wire structure is designed so that the backing texturizing wire can be mechanically (preferably hydraulically) lifted from the dewatering and sheet-forming wire, the machine is able to produce standard tissue in addition to texturized tissue paper without any conversion whatsoever.

The backing texturizing wire, due to the texture and the wire itself, naturally reduces the overall dewatering capacity and should thus be patterned as coarse as possible to minimize detrimenting the dewatering capacity by the backing texturizing wire itself.

The fineness of the texture in the tissue paper, consisting of areas differing in basis weight, is limited to the extent with which blockage of dewatering (due to the texture of the second wire) in the Z direction is side-stepped by the water transport within the sheet-forming wire in the X-Y direction. For as fine a texture as possible in the tissue paper the dewatering wire needs to be selected as thin as possible (low water transport in the X and Y direction). The wires have a wire gauge of 0.1 to 0.4 mm. To avoid lengthy water transport in the X and Y direction a wire gauge smaller than 0.3 mm should be employed, smaller than 0.2 mm being even better. It is best to employ a wire gauge smaller than 0.1 mm.

In case the dewatering zones are interconnected in the texturizing wire, the zones of elevated basis weight in the tissue paper are interconnected netted. The resulting influence on the strengths is relatively slight or none at all. The texturizing wires producing paper with netted zones of elevated basis weight may also be belts in which the supporting fabric is supplemented by some other material which is structured on the side coming into contact with the paper, examples of which read from EP 0 135 231 B (producing cushions with elevated basis weight) and WO 93/0047A (producing a continuous net with elevated basis weight).

In case the wire zones of blocked dewatering in the texturizing wire are interconnected, a tissue paper materializes having joined zones of diminished basis weight, resulting in strengths being detrimented. In this case, use can also be made e.g. of a perforated film, belt etc. in addition to a coarse wire having a closed mesh texture in the concrete design. Due to the relatively small dewatering zones in the joined zones of diminished basis weight the stock concentration is high. This results in a "cushioning effect" positively influencing the thickness and absorptivity of multi-ply products (e.g. as the middle ply in three-ply kitchen towel, as the bottom ply in two-ply products, the side with the cushioning facing inwards).

DESCRIPTION OF EXAMPLE EMBODIMENTS OF THE INVENTION

Figure 1A:
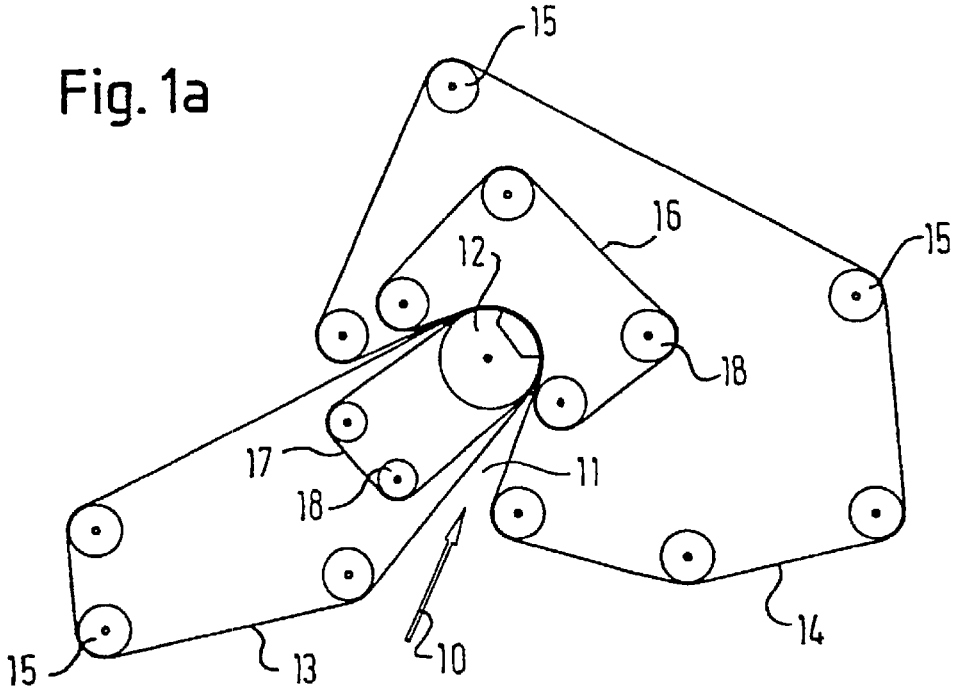
FIG. 1*a* is a diagrammatic illustration of one embodiment of a head box section and main dewatering section of a tissue paper machine.
Figure 1B:
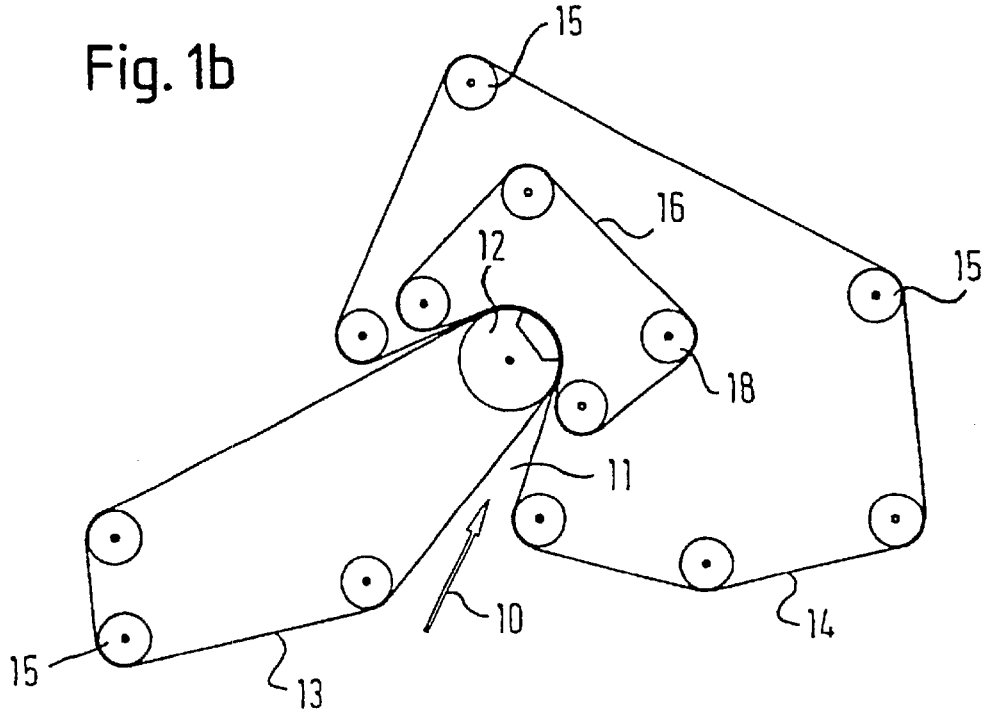
FIG. 1*b* is a diagrammatic illustration of another embodiment as shown in FIG. 1*a;*

Referring now to FIG. 1*a* there is illustrated diagrammatically a sheet-forming section of a paper machine. Provided in the head box section 10 is a stock infeed gap 11 and a dewatering and forming (sheet forming) roll 12. The stock infeed gap 11 in this arrangement is formed by an inner dewatering and sheet-forming wire 13 and an outer dewatering and sheet-forming wire 14 guided differing in extensibility about diverse guide rolls 15 whilst being guided about part of the circumference of the dewatering and forming roll 12. Sheet-forming takes place between these two wires. At the side facing away from the sheet-forming section the dewatering and sheet-forming wire 14 is backed by a texturizing wire 16 provided textured and the dewatering and sheet-forming wire 13 is backed by a texturizing wire 17 provided textured. These texturizing wires too, preferably differ in extensibility in being guided over guide rolls 18, they also featuring an extensibility differing to that of the corresponding dewatering and sheet-forming wire in each case and are guided over separate guide rolls, as evident from FIG. 1*a*. This makes it possible to lift the texturizing wire from the dewatering and sheet-forming wire, preferably hydraulically, without involving any major conversion. Most of the water passes the dewatering and sheet-forming wire 14 and texturizing wire 16 so that lifting in the case of the texturizing wire 16 would not be of advantage.

Where in agreement, FIG. 1*b* showing the modified embodiment indicates the same reference numerals as FIG. 1*a*. In this case a texturizing wire 16 is assigned only to the dewatering and sheet-forming wire 14, since dewatering is done substantially via the dewatering and sheet-forming wire 14.

Figure 1C:
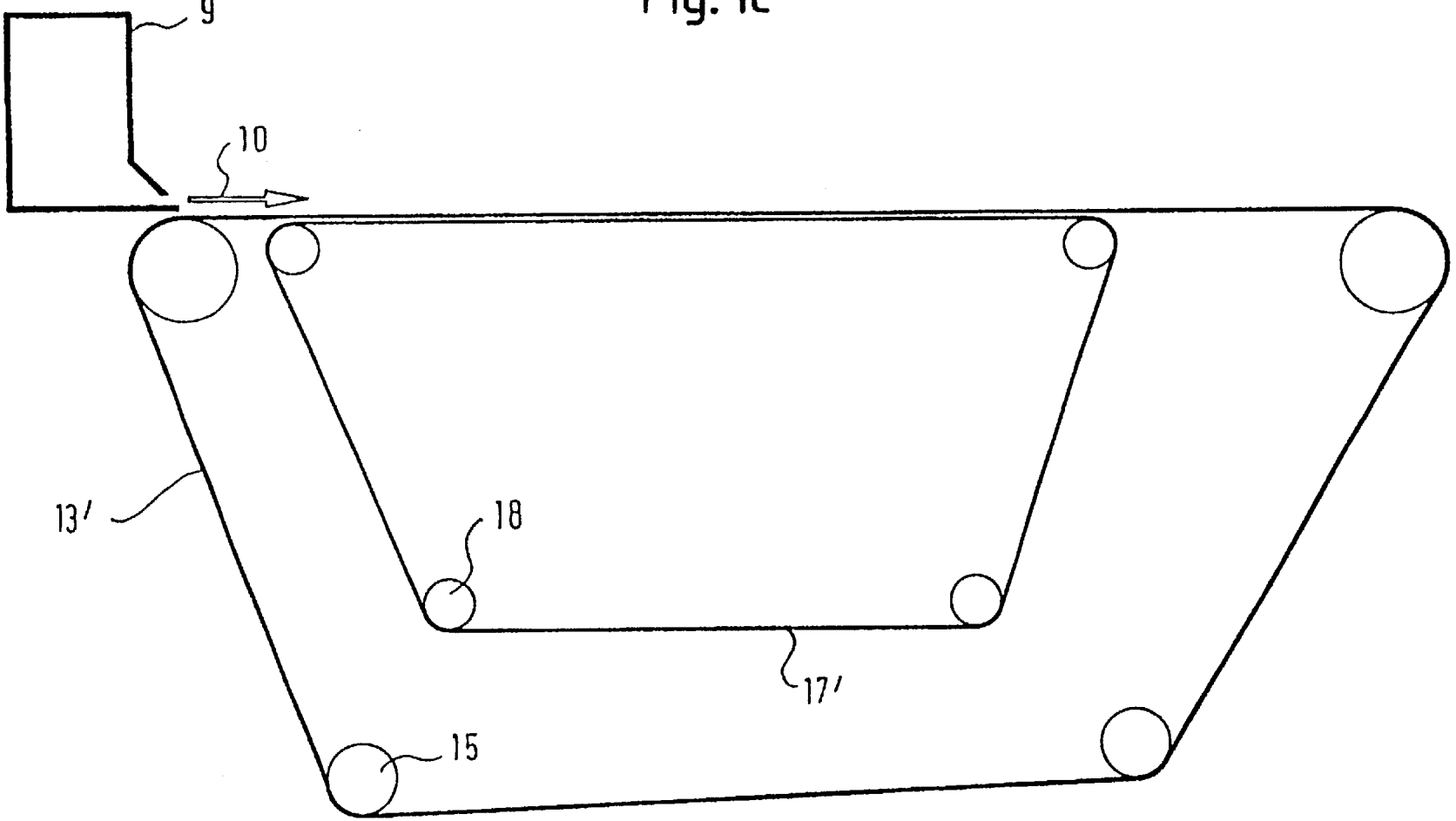
FIG. 1*c* is a diagrammatic illustration of a further embodiment as shown in FIGS. 1*a* and 1*b;*

In the embodiment as shown in FIG. 1*c*, a head box 9 is provided from which the stock is deposited in the direction of the arrow 10 on a horizontally oriented dewatering and sheet-forming wire 13'. Over a certain distance the dewatering and sheet-forming wire 13' is backed by a texturizing wire 17'.

Figure 2A:
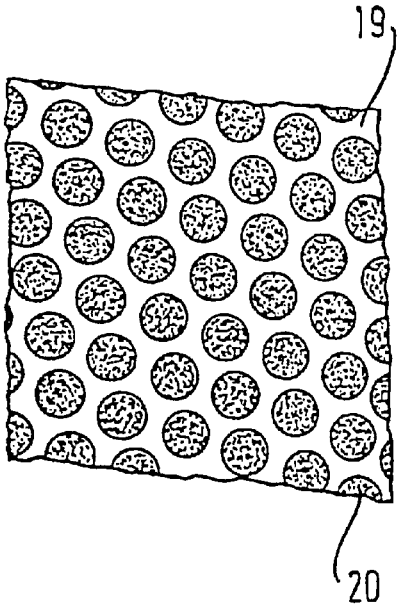
FIGS. 2*a* and 2*b* are each illustrations of part of a texturizing wire having interconnected dewatering zones.
Figure 3A:
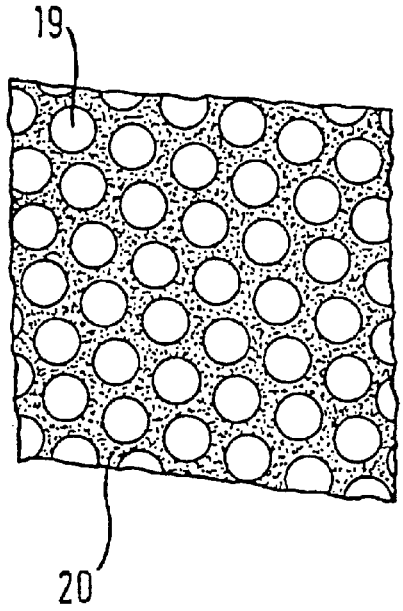
FIGS. 3*a* and 3*b* are each illustrations of part of a texturizing wire in which the zones blocking dewatering are interconnected.
Figure 2B:
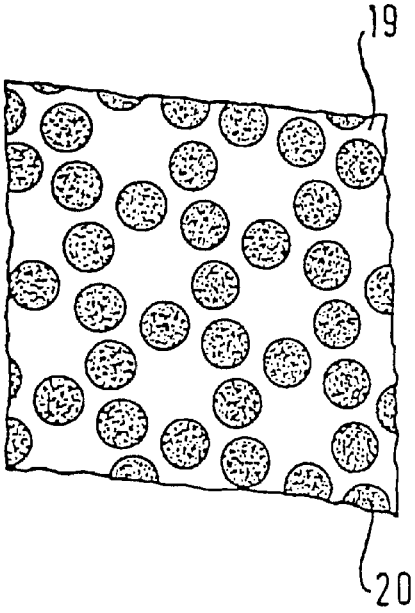
Figure 3B:
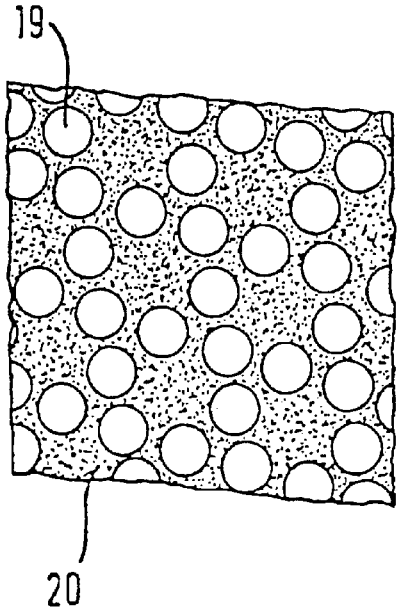

Referring now to FIGS. 2*a*, 2*b*, 3*a* and 3*b*, there is illustrated how the texturizing wire comprises dewatering wire zones 19 and wire zones 20 blocking dewatering, it being these zones which, depending on the specifications and particular application, may be patterned highly diversely. In FIGS. 2*a* and 2*b* the dewatering zones 19 are interconnected in a net-like manner. In FIGS. 3*a* and 3*b* the zones 20 blocking dewatering are interconnected in a net-like manner. As already discussed above, this results in the differences as described.

Via the closed wire zones of the texturizing wires dewatering by the sheet-forming wire in the Z direction is inhibited or strongly restricted, resulting in an added fiber concentration in the zones 19 of unrestricted dewatering. For as fine a texture as possible in the tissue paper the dewatering and sheet-forming wire needs to be selected as thin as possible to achieve a low water transport in the X and Y direction.

Backing by a texturizing wire in the scope as shown is in the region of the main dewatering zone, i.e. in the transition from fiber suspension to fiber web with a stock density >10%.

What is claimed is:

1. A tissue paper machine comprising a head box section, a dewatering and sheet-forming section, and a drying section; wherein an outer and inner dewatering and sheet-forming wire in the head box section or in the sheet-forming section is backed by a texturizing wire having dewatering wire zones and closed wire zones.

2. The tissue paper machine according to claim 1, wherein two dewatering and sheet-forming wires are provided in the head box section or in the sheet-forming section; each of the dewatering and sheet-forming wires being backed by a texturizing wire.

3. The tissue paper machine according to claim 1, wherein the texturizing wire backs a main dewatering zone, in a transition from fiber stock suspension to fiber web with a stock density greater than about 10%.

4. The tissue paper machine according to claim 3, wherein the texturizing wire backs a region of a dewatering and forming roll.

5. The tissue paper machine according to claim 1, wherein the texturizing wire can be mechanically lifted from the dewatering and sheet-forming wire.

6. The tissue paper machine according to claim 1, wherein the texturizing wire is patterned relatively coarse.

7. The tissue paper machine according to claim 1, wherein the dewatering and sheet-forming wire is designed for a low water transport in the X and Y directions.

8. The tissue paper machine according to claim 7, wherein the dewatering and sheet-forming wire is relatively thin.

9. The tissue paper machine according to claim 1, wherein at least part of the dewatering wire zones are interconnected in the texturizing wire.

10. The tissue paper machine according to claim 1, wherein the closed wire zones of blocked dewatering are interconnected in the texturizing wire.

11. The tissue paper machine according to claim 1, wherein the texturizing wire and the dewatering and sheet-forming wire have separate roll guides.

12. The tissue paper machine according to claim 1, wherein the texturizing wire and the dewatering and sheet-forming wire have different extensions.

13. The tissue paper machine according to claim 1, wherein two texturizing wires are provided, and the pattern of the two texturizing wires is disposed either repeated or offset.

14. A method of producing a tissue paper product, comprising the following steps:

depositing a fiber stock suspension on a dewatering and sheet-forming wire backed by a texturing wire having dewatering wire zones and closed wire zones;

inhibiting or strongly restricting dewatering by the dewatering and sheet-forming wire in the Z direction via the closed wire zones; and boosting the concentration of fibers in the dewatering wire zones of unrestricted dewatering.

* * * * *